US011078614B2

(12) United States Patent
Zhao et al.

(10) Patent No.: US 11,078,614 B2
(45) **Date of Patent: *Aug. 3, 2021**

(54) DRUM WASHING MACHINE

(71) Applicant: QINGDAO HAIER DRUM WASHING MACHINE CO., LTD., Shandong (CN)

(72) Inventors: Zhiqiang Zhao, Shandong (CN); Sheng Xu, Shandong (CN)

(73) Assignee: QINGDAO HAIER DRUM WASHING MACHINE CO., LTD, Shandong (CN)

( * ) Notice: Subject to any disclaimer, the term of this patent is extended or adjusted under 35 U.S.C. 154(b) by 79 days.

This patent is subject to a terminal disclaimer.

(21) Appl. No.: 16/483,228

(22) PCT Filed: Feb. 6, 2018

(86) PCT No.: PCT/CN2018/075365
§ 371 (c)(1),
(2) Date: Aug. 2, 2019

(87) PCT Pub. No.: WO2018/141299
PCT Pub. Date: Aug. 9, 2018

(65) Prior Publication Data

US 2020/0232138 A1 Jul. 23, 2020

(30) Foreign Application Priority Data

Feb. 6, 2017 (CN) ..... 201710065841.4

(51) Int. Cl.
*D06F 37/04* (2006.01)
*D06F 23/06* (2006.01)
(Continued)

(52) U.S. Cl.
CPC ..... *D06F 37/04* (2013.01); *D06F 23/065* (2013.01); *D06F 37/20* (2013.01); *D06F 39/02* (2013.01); *D06F 39/14* (2013.01)

(58) Field of Classification Search
CPC ..... D06F 21/00; D06F 21/02; D06F 21/10; D06F 23/00; D06F 23/02; D06F 23/025;
(Continued)

(56) References Cited

U.S. PATENT DOCUMENTS 2,284,243 A 5/1942 Zimarik
3,032,887 A * 5/1962 Whyte ..... D06F 58/02 34/524
(Continued)

FOREIGN PATENT DOCUMENTS

CN 2294988 Y 10/1998
CN 105951346 A 9/2016
(Continued)

OTHER PUBLICATIONS

International Search Report for related PCT Application No. PCT/CN2018/075365 dated May 10, 2018.
(Continued)

*Primary Examiner* — David G Cormier
(74) *Attorney, Agent, or Firm* — Burns & Levinson, LLP; Joseph M. Maraia

(57) ABSTRACT

A drum washing machine includes a washing machine housing. A washing drum is disposed in the washing machine housing and includes a front washing drum and a rear washing drum. The front washing drum is sealedly connected to the rear washing drum. The rear washing drum is operative to rotate relative to the front washing drum. The rear washing drum is further operative to rotate along with a motor, and the front washing drum is stationary when the rear washing drum is rotating along with the motor.

7 Claims, 5 Drawing Sheets

(51) Int. Cl.
*D06F 37/20* (2006.01)
*D06F 39/02* (2006.01)
*D06F 39/14* (2006.01)

(58) Field of Classification Search
CPC ..... D06F 25/00; D06F 35/008; D06F 37/02; D06F 37/04; D06F 37/06; D06F 37/08; D06F 37/10; D06F 37/26; D06F 37/263; D06F 37/266; D06F 37/28; D06F 39/12; D06F 39/14
See application file for complete search history.

(56) References Cited

U.S. PATENT DOCUMENTS

| | | | | |
|---|---|---|---|---|
| 3,677,039 | A | 7/1972 | Files | |
| 4,711,104 | A | 12/1987 | Ikeda | |
| 6,311,527 | B1 * | 11/2001 | Monteiro | D06F 21/04 68/140 |
| 7,263,863 | B2 | 9/2007 | Brinkmann et al. | |
| 9,207,016 | B2 | 12/2015 | Park et al. | |
| 2006/0016092 | A1 * | 1/2006 | Kim | D06F 58/20 34/130 |
| 2013/0057130 | A1 * | 3/2013 | Kim | D06F 37/266 312/228 |
| 2016/0258101 | A1 * | 9/2016 | Hake | D06F 58/30 |

FOREIGN PATENT DOCUMENTS

| | | | |
|---|---|---|---|
| JP | 61141398 | A | 6/1986 |
| JP | 2015029546 | A | 2/2015 |

OTHER PUBLICATIONS

European Search Report dated Jul. 31, 2020, for related EP Application No. 18748457.

* cited by examiner

DRUM WASHING MACHINE

CROSS REFERENCE TO RELATED APPLICATIONS

This application is a U.S. National Phase Application of co-pending International Patent Application number PCT/CN2018/075365 entitled "Drum Washing Machine" and filed on Feb. 6, 2018, which claims the priority of China Patent Application No. 201710065841.4 titled "Drum Washing Machine" and filed Feb. 6, 2017 before the State Intellectual Property Office of People's Republic of China, disclosures of both of which are incorporated herein by reference in their entireties.

TECHNICAL FIELD

The present disclosure relates to the technical field of washing machines, for example, to a drum washing machine.

BACKGROUND

A drum washing machine in the related art includes an inner drum and an outer drum. A user can keep the inner drum of the washing machine clean in a washing and maintenance process of the washing machine, but the outer drum is sleeved outside the washing drum (i.e., the inner drum), so that an interlayer, namely a washing machine groove, is disposed between the inner drum and the outer drum. The washing machine groove is a harboring site for dirt, and the user cannot remove the inner drum and the outer drum on his/her own to clean an outer wall of the inner drum and an inner wall of the outer drum. Furthermore, the residual water in the inner drum and outer drum that is left from the operation of the washing machine is not easy to clean and evaporate, leading to the growth of a large amount of bacteria on the drum walls. As time proceeds, more and more areas would be attached with dirt, and the dirt also sticks more and more fast to the drum walls. This would cause secondary pollution to the clothes, seriously threatening the health of consumers. Therefore, the user needs to periodically ask a professional technician for professional washing of the washing machine to clean the washing machine, which is time-consuming and labor-consuming.

Therefore, it is a technical problem that needs to be solved by those skilled in the art to provide a washing machine that is able to solve the problem that the washing drum in the related art needs to be periodically cleaned.

SUMMARY

The present disclosure provides a drum washing machine, which can solve the problem that a washing machine drum in the related art needs to be periodically cleaned.

There is provided a drum washing machine that includes a washing machine housing. A washing drum is disposed in the washing machine housing and includes a front washing drum and a rear washing drum. The front washing drum is sealedly connected to the rear washing drum, and the rear washing drum is operative to rotate relative to the front washing drum. The rear washing drum is operative to rotate along with a motor, and the front washing drum is at rest when the rear washing drum is rotating along with the motor.

The washing drum according to the present disclosure includes a front washing drum and a rear washing drum. The rear washing drum can rotate relative to the front washing drum, then clothes and water in the washing drum are driven to rotate to lift the clothes, which are then allowed to fall and be beaten, thereby achieving the function of washing clothes. Because the washing drum has no outer drum member and only has a rear washing drum which has no hole and can rotate, an outer wall of the washing drum cannot be filled with water, especially water after washing. Thus, dirt can be prevented from being accumulated on the outer wall of the washing drum, the outer wall of the washing drum is free from needing cleaning. In addition, water that is present between the inner drum and the outer drum of the original washing drum is also saved, thereby further saving water.

Optionally, the front washing drum has a length smaller than the rear washing drum.

The length of the front washing drum is less than that of the rear washing drum so that the rear washing drum can rotate when there is sufficient water, ensuring the washing cleaning rate.

Optionally, the washing machine housing is provided with a loading port, and a door and window is disposed at the loading port, a sealing groove is arranged in a side wall of the front washing drum contacting the door and window or in a side wall of the door and window contacting the front washing drum, and a first sealing ring is disposed in the sealing groove.

The sealing groove and the first sealing ring are arranged to seal a space between the front washing drum and the door and window of the washing machine, so that the washing water is prevented from flowing out. Thus, the washing machine can be prevented from electric leakage, short circuit and the like or electric shock of a user.

Optionally, the washing machine further includes a sealing window pad disposed between the door and window and the front washing drum.

The sealing window pad is arranged to seal the space between the door and window and the front washing drum. Meanwhile, the appearance of the washing machine is more attractive after the door and window is opened.

Optionally, the sealing window pad includes an inner lip, an outer lip, and a folding member connecting the inner lip to the outer lip. The inner lip is engaged with the front washing drum via a second clamp, and the outer lip is engaged with a front panel of the washing machine housing via a first clamp.

The first clamp and the second clamp can tightly clamp the sealing window pad on the washing machine, so that the sealing window pad would not loosen along with the opening or closing of the door and window. Therefore, the service life of the sealing window pad of the door and window is prolonged.

Optionally, a water inlet valve is disposed on the housing of the washing machine and is communicated with a detergent box via a water inlet pipeline, and the detergent box is communicated with the water inlet hole via a water injection pipe.

Optionally, a central axis of the washing drum is inclined relative to the horizontal plane, and an angle formed between the central axis and the horizontal plane is $\alpha$, where $0 \leq \alpha < 90°$.

Therefore, the washing machine is better suitable for the inclined-type drum washing machine. The drum has an angle of inclination relative to the horizontal plane, thereby making it convenient to take out and put in clothes.

Optionally, at least one lifting rib is arranged on an inner side wall of the rear washing drum.

A plurality of lifting ribs are arranged inside the rear washing drum, so that the clothes inside the rear washing drum can be better lifted, fall down and be beaten for washing purposes.

Optionally, the front washing drum is connected to the rear washing drum via the rotary bearing, the rear washing drum is sleeved on an inner ring of the rotary bearing, the front washing drum is engaged with an outer ring of the rotary bearing, and a second sealing ring is arranged between the front washing drum and the rear washing drum.

Optionally, a limiting ring having an F-shaped cross-section is disposed at a joint of the front washing drum and the rear washing drum;

The limiting ring includes a first vertical limiting ring body, a first transverse limiting ring body disposed on top of the first vertical limiting ring body, and a second transverse limiting ring body parallel to the first transverse limiting ring body.

The second sealing ring is disposed between the first transverse limiting ring body and the second transverse limiting ring body, and the rotary bearing is disposed in a space formed by the first vertical limiting ring body, the second transverse limiting ring body, and an outer wall of the rear washing drum.

The sealing ring is arranged between the first transverse limiting ring body and the second transverse limiting ring body, namely the sealing ring is arranged in a rectangular closed space formed by the first transverse limiting ring body, the second transverse limiting ring body, the first vertical limiting ring body and a lower drum. The rotary bearing is arranged in a space formed by the first vertical limiting ring body, the second transverse limiting ring body, and an outer wall of the lower drum. Such an arrangement not only plays a good sealing role, but also ensures that the rear washing drum is operative to rotate relative to the front washing drum.

Optionally, the second sealing ring is a lip-shaped sealing ring.

The lip-shaped sealing ring has a self-sealing effect. The lip is acted by working pressure to make the lip compress a sealing coupling surface, the abrasion loss can be automatically compensated, and therefore the lip-shaped sealing ring has better sealing performance.

Figure 1:
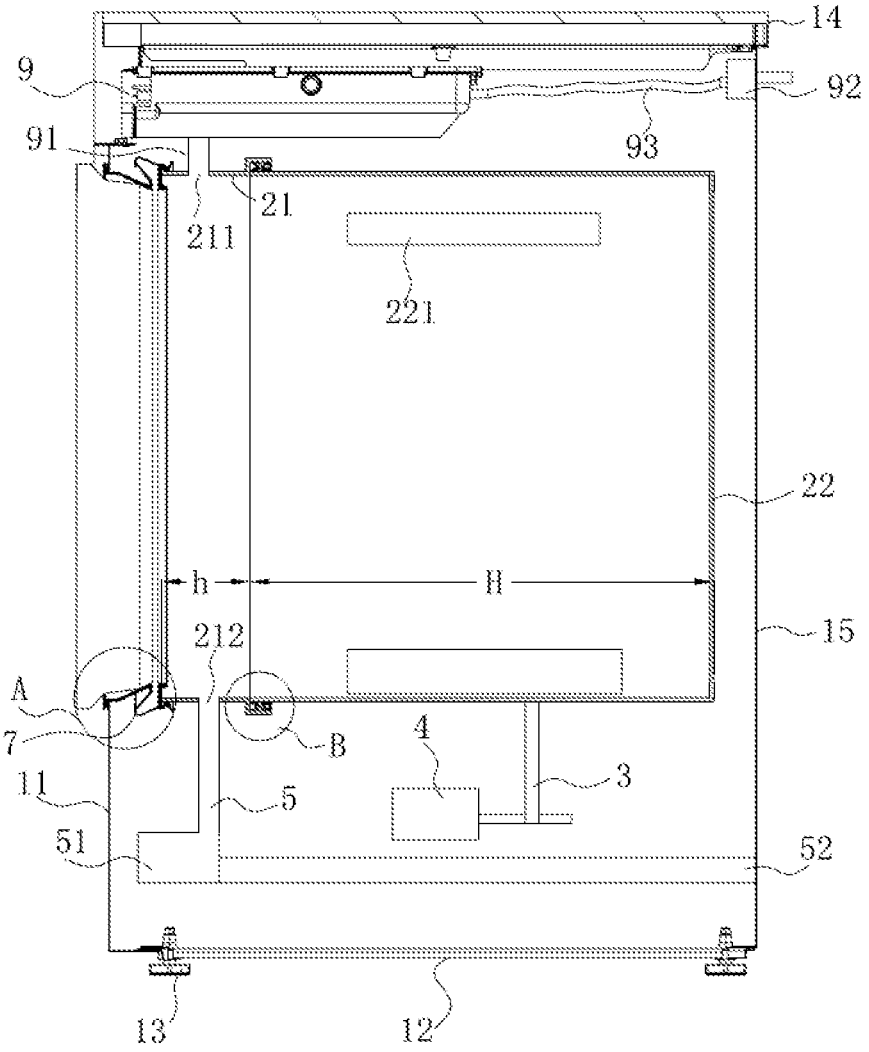
FIG. 1 is a schematic diagram of a drum washing machine of Embodiment 1 according to the present disclosure.

1. Washing machine housing; 11. Front panel; 111. Hook ring; 12. Chassis; 13. Ground feet; 14. Upper deck panel; 15. Rear backplate; 21. Front washing drum; 211. Water inlet hole; 212. Water outlet hole; 213. Sealing groove; 214. Limiting ring; 2141. First vertical limiting ring body; 2142. First transverse limiting ring body; 2143. Second transverse limiting ring body; 215. Limiting annular protrusion; 22. Rear washing drum; 221. Lifting rib; 3. Belt; 4. Motor; 5. Drain connecting pipe; 51. Drain valve; 52. Drain pipe; 61. First sealing ring; 62. Second sealing ring; 7. Sealing window pad; 71. Inner lip; 72. Outer lip; 73. Folding member; 74. First clamp; 75. Second clamp; 8. Door and window; 81. sealing door; 9. Detergent box; 91. Water injection pipe; 92. Water inlet valve; 93. Water inlet pipeline; 10. Rotary bearing.

DETAILED DESCRIPTION

Embodiment 1

As illustrated in FIGS. 1 to 4, the present embodiment provides a drum washing machine which does not require periodical cleaning of dirt on an outer wall or an inner wall of a washing drum, thus making it more water-saving. The drum washing machine includes a washing machine housing 1, and a washing drum is arranged in the washing machine housing 1 and is configured to rotate for purposes of washing clothes. The washing drum includes a front washing drum 21 and a rear washing drum 22. The front washing drum 21 is sealedly connected to the rear washing drum 22. The rear washing drum 22 is operative rotate relative to the front washing drum 21. The front washing drum 21 is at rest in a rotating process of the rear washing drum 22, and water in the washing drum can be ensured to rotate along with the rear washing drum 22 to fulfill the purpose of washing clothes. The rear washing drum 22 is connected to the motor 4 via a belt 3, and is operative to rotate along with the motor 4, that is, the belt 3 is operative to rotate along with the motor 4. Meanwhile, the belt 3 is operative to drive the rear washing drum 22 to rotate. At this moment, the front washing drum 21 is stationary, and because the front washing drum 21 is stationary, there is no need to position water injection and water drainage=. Therefore, in the present embodiment, the front washing drum 21 is provided with a water inlet hole 211 and a water outlet hole 212, and the water outlet hole 212 is communicated with the drain valve 51 via the drain connecting pipe 5. After the washing is finished, sewage enters the drain pipe 52 through the water outlet hole 212 and the drain valve 51 and is discharged out of the washing machine.

In order to make the water in the washing drum rotate with the rear washing drum 22, in the present embodiment, the length h of the front washing drum 21 is smaller than the length H of the rear washing drum 22. The length of the front washing drum 21 can be as small as possible, but it should be noted that the length of the front washing drum 21 should not affect the arrangement of the water outlet hole 212, the water inlet hole 211, and the sealing window pad 7. The front washing drum 21 may be flexibly fixed in the washing machine housing 1 by a spring or a damper, or may be firmly fixed in the washing machine housing 1 with total rigidity.

The drum washing machine further includes the sealing window pad 7 for well sealing a space between the door and window 8 and the washing drum, so that the washing water is prevented from flowing out to affect washing or cause the electric leakage of internal circuits of the washing machine. A side of the washing machine housing 1 is provided with a loading port, the loading port is provided with a door and window 8, and the sealing window pad 7 is disposed between the door and window 8 and the front washing drum 21.

In the present embodiment, the rear washing drum 22 and the front washing drum 21 are both non-porous drums, that is, no hole is provided in a side wall of both the rear washing drum and of the front washing drum, and the front washing drum 21 is provided with one water inlet hole 211 and one water outlet hole 212. Such structure can ensure that the rear washing drum 22 can be filled with water or drained without being positioned after rotation. Meanwhile, the front washing drum and the rear washing drum are not soaked by water, so that the rear washing drum is not subjected to resistance of water passing through holes in the rotating process, providing smoother rotation.

Meanwhile, the rear washing drum 22 and the front washing drum 21 are non-porous structure drums. After water inflow is finished, the drain pump or the drain valve is not started and is in a sealed state. Detergent and washing water are sealed in the front washing drum and the rear washing drum, and clothes to be washed are also placed in the front washing drum and the rear washing drum. Such structure can realize the integrated design of the water drum and the laundry drum, thereby preventing water from flowing out of the outer wall of the washing drum to cause dirt being accumulated on the outer wall, and saving water.

Figure 2:
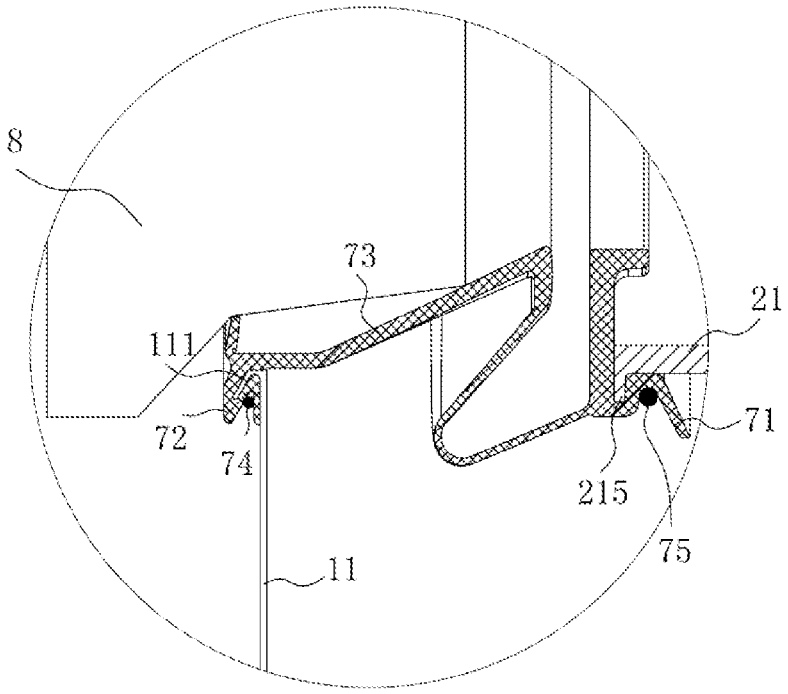
FIG. 2 is a partial enlarged view of part A of FIG. 1.

As illustrated in FIG. 2, the sealing window pad 7 includes an inner lip 71, an outer lip 72, and a folding member 73 connecting the inner lip 71 to the outer lip 72. The inner lip 71 is engaged with the front washing drum 21 via a second clamp 75, and the outer lip 72 is engaged with a front panel 11 of the washing machine housing 1 via a first clamp 74. The front panel 11 is provided with a hook ring 111 embedded in the outer lip 72, and the joint of the front washing drum 21 and the inner lip 71 is provided with a limiting ring protrusion 215. The first clamp 74 clamps the outer lip 72 and the hook ring 111 to provide a good sealing performance, and the second clamp 75 clamps the inner lip 71 and the limiting ring convex 215 to provide a good sealing performance.

At least one lifting rib 221 is arranged on an inner side wall of the rear washing drum 22. The lifting ribs 221 are provided for the purpose of lifting the clothes which are then allowed to rapidly fall during the washing process. Thus, the clothes inside can be better lifted, and then let fall to be beaten for washing purposes.

In order that the front washing drum 21 rotates relative to the rear washing drum 22, in the present embodiment, the front washing drum 21 is connected to the rear washing drum 22 via a rotary bearing 10. The rear washing drum 22 is sleeved on an inner ring of the rotary bearing 10, the front washing drum 21 is engaged with an outer ring of the rotary bearing 10, and a second sealing ring 62 is disposed between the front washing drum 21 and the rear washing drum 22.

Figure 3:
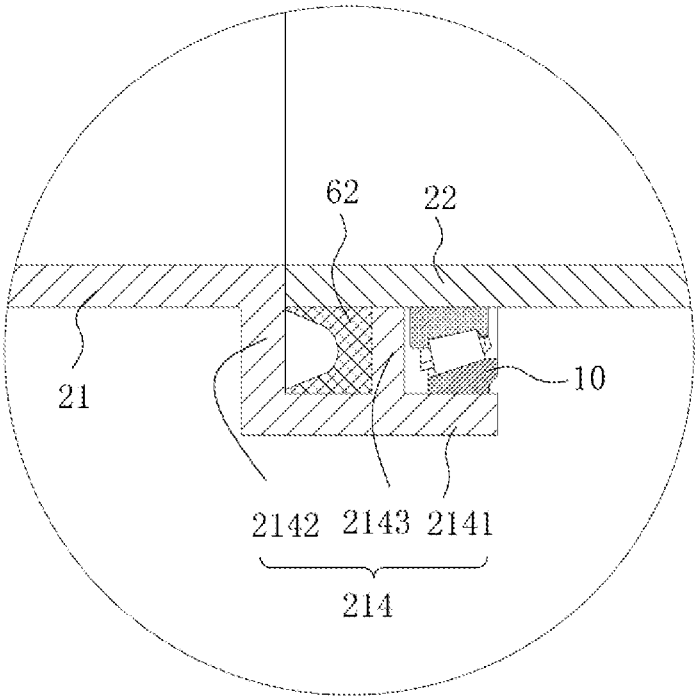
FIG. 3 is a partial enlarged view of a part B of FIG. 1.

In order to prevent water leakage at the joint between the front washing drum 21 and the rear washing drum 22, a limiting ring 214 having an F-shaped cross-section is disposed at the joint between the front washing drum 21 and the rear washing drum 22. As illustrated in FIG. 3, the limiting ring 214 includes a first vertical limiting ring body 2141, a first transverse limiting ring body 2142 disposed on top of the first vertical limiting ring body 2141, and a second transverse limiting ring body 2143 disposed parallel to the first transverse limiting ring body 2142. The second sealing ring 62 is disposed between the first transverse limiting ring body 2142 and the second transverse limiting ring body 2143, and the rotary bearing 10 is disposed in a space formed by the first vertical limiting ring body 2141, the second transverse limiting ring body 2143, and an outer wall of the rear washing drum 22. The second sealing ring 62 is a lip-shaped sealing ring. The limiting ring 214 is integrated with the front washing drum 21, and such structure can further improve the sealing effect between the front washing drum 21 and the limiting ring 214.

The front washing drum 21 is connected to the rear washing drum 22 via the rotary bearing 10, so that the rear washing drum 22 can be effectively ensured to rotate relative to the front washing drum 21. Meanwhile, the sealing ring is arranged between the rear washing drum 22 and the front washing drum 21, so that water in the washing drum can be prevented from flowing out of the washing drum to affect the operation of the washing machine.

When the rear washing drum 22 rotates and is in low-speed washing, the rotating speed is 0-200 r/min; and when in high-speed dewatering and drying, the rotating speed is 600-1800 rpm. The second sealing ring 62 is preferably a lip-shaped sealing ring, and such sealing ring has a self-sealing effect. The lip is acted by working pressure to make the lip compress a sealing coupling surface, and the abrasion loss can be automatically compensated. The working pressure originated from the pre-compression force of the front washing drum 21 and the rear washing drum 22, the self-gravity of the front washing drum 21, and the working pressure of the internal liquid. The second sealing ring 62 may be the shape of Y, V, U, J or L.

The rotary connection (dynamic connection) between the front washing drum 21 and the rear washing drum 22 is a bearing connection, the front washing drum 21 and the rear washing drum 22 are respectively connected to an outer ring and an inner ring of the bearing. The rotary bearing can be selected from various types, and the rotary bearing 9 includes bearings, such as ball bearings, roller bearings and the like. The bearing type in the present embodiment may be a tapered roller bearing, a cylindrical roller bearing, a ball roller bearing, or the like. The tapered roller bearing is selected in the present embodiment, and the tapered ball bearing includes a bearing inner ring, a bearing bracket, tapered rollers, and a bearing outer ring.

Figure 4:
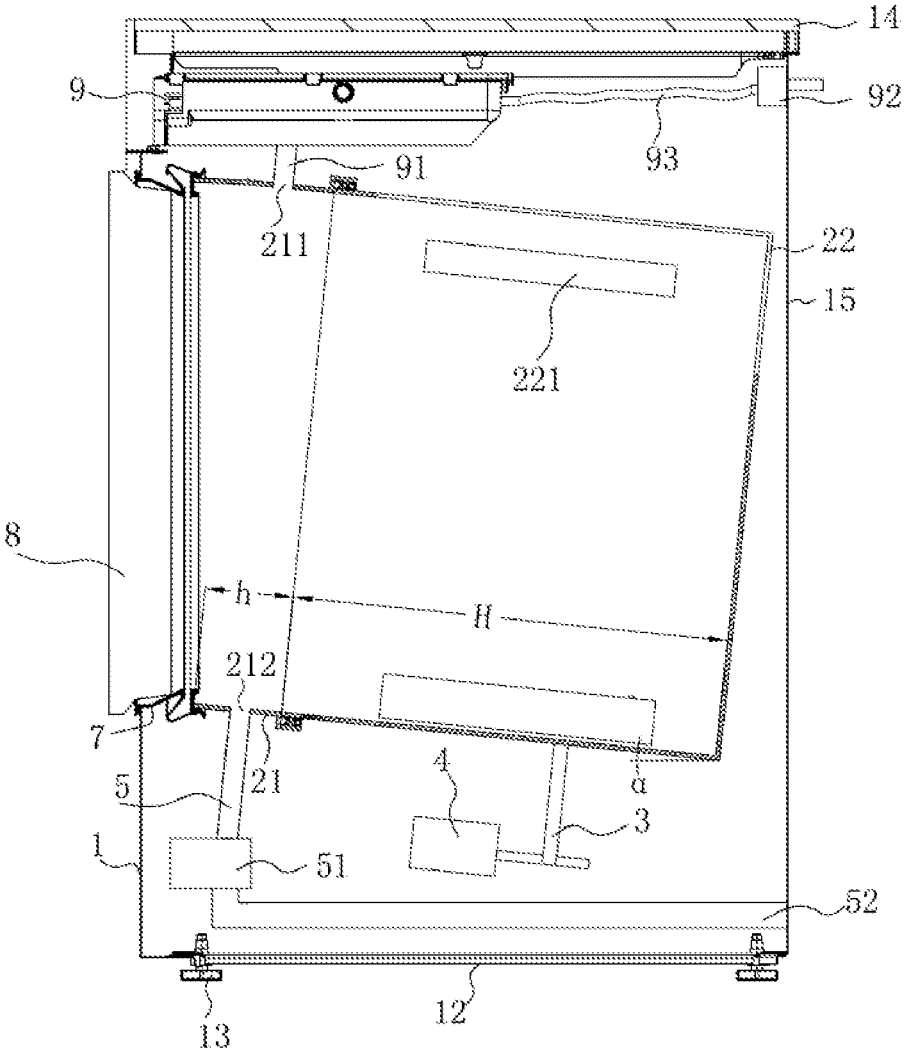
FIG. 4 is a schematic diagram of a drum washing machine with an inclined drum according to Embodiment 1 of the present disclosure.

As illustrated in FIG. 1 and FIG. 4, the drum washing machine is filled with water through a water inlet valve 92 provided on the washing machine housing 1. The water inlet valve 92 is communicated to a tap water pipeline and is communicated to a detergent box 9 through a water inlet pipeline 93, and the detergent box 9 is communicated to the water inlet hole 211 through a water injection pipe 91. The tap water sequentially passes through the water inlet valve 92, the water inlet pipe 93 and the detergent box 9, and then enters the front washing drum 21.

The bottom of the washing machine housing 1 is further provided with a chassis 12, the bottom of the chassis 12 is provided with ground feet 13 for supporting the whole washing machine, and the top of the washing machine housing 1 is provided with an upper deck panel 14.

As illustrated in FIG. 4, in order to facilitate the taking out and putting in of clothes for the user, a central axis of the washing drum is inclined relative to the horizontal plane, and an angle formed between the central axis and the horizontal plane is $\alpha$, where $0 \leq \alpha < 90°$.

Embodiment 2

Figure 5:
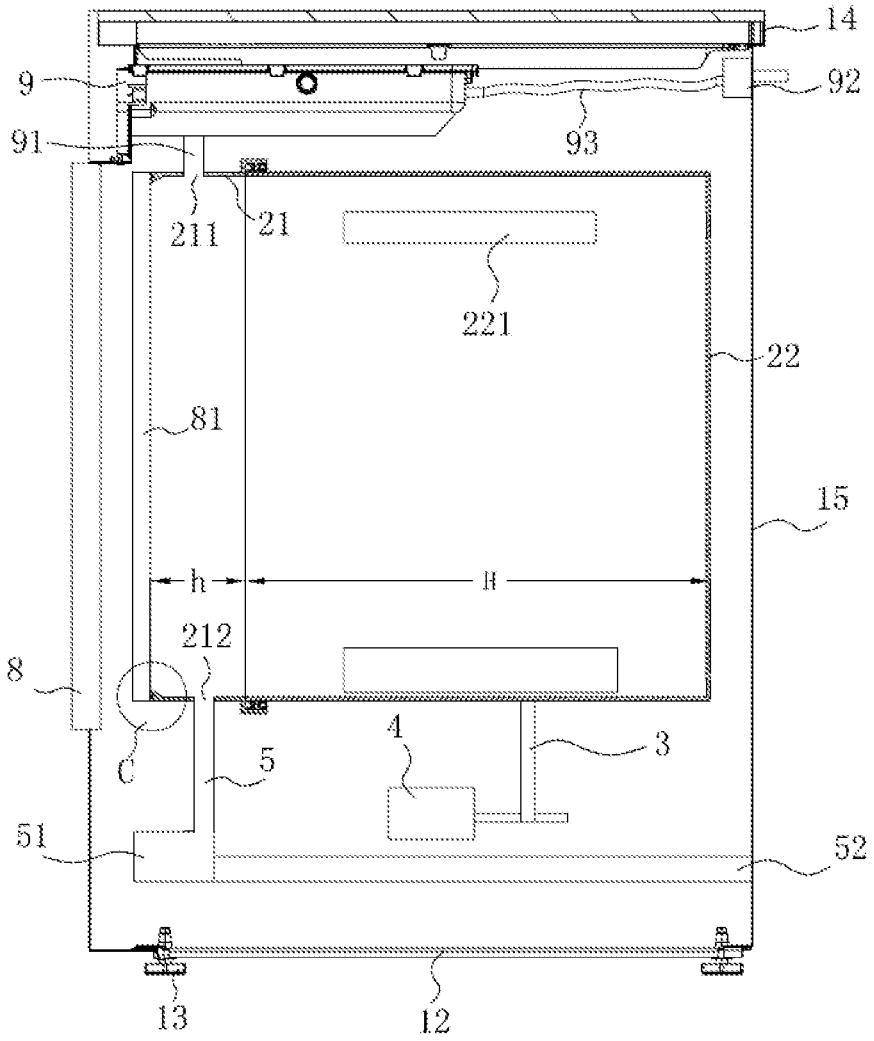
FIG. 5 is a schematic diagram of a drum washing machine of Embodiment 2 according to the present disclosure.
Figure 6:
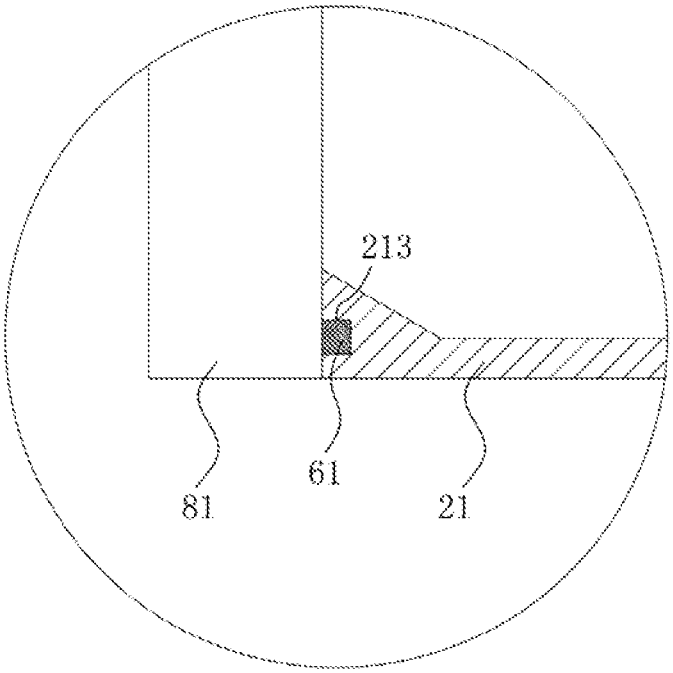
FIG. 6 is a partial enlarged view of part C of FIG. 5.

The difference from Embodiment 1 lies in that a sealing window pad 7 is not provided in the present embodiment, and since the sealing window pad 7 is not provided, a door and window 8 of the drum washing machine of the present embodiment is simpler compared to that of the drum washing machine in Embodiment 1. A sealing groove 213 (referring to FIG. 5 and FIG. 6) is provided on an side wall of the front washing drum 21 contacting the door and window 8 of the washing machine, and a first sealing ring 61 is provided in the sealing groove 213. When the door and window 8 is closed, the door and window 8 contacts the front washing drum. Because the first sealing ring 61 is provided on a side wall of the front washing drum 21, stationary sealing can be realized between the door and window 8 and the front washing drum 21 after the door and window 8 is closed.

In other embodiments, the sealing groove 213 may be provided in a sidewall of the door and window 8 contacting the front washing drum 21, thereby achieving sealing of the door and window 8 and the front washing drum 21.

A side of the door and window 8 adjacent to the washing drum is provided with a sealing door 81. The sealing door 81 can be hingedly connected to the washing drum or connected to the door and window 8 via a rotary shaft, and no matter what kind of the connection, it is ensured that the washing drum can be sealed integrally by the sealing door, and the washing water is prevented from flowing out from a front end of the front washing drum 21. If the sealing door 81 is provided, the sealing groove 213 should be provided in the sealing door 81 or in the side wall of the front washing drum 21.

In the present embodiment, a driving wheel is provided on an outer side wall of the rear washing drum 22, that is, the driving wheel is sleeved on the rear washing drum 22 to drive the rear washing drum to rotate along with the motor 4 and the belt 3.

The rear washing drum 22 may also be fixedly provided on the washing machine rear back plate 15 via a rotary shaft (not shown in the figure) and a flange (not shown in the figure), at the moment, the driving wheel is disposed on the rotary shaft and can drive the rotary shaft to rotate, and the rotary shaft is fixedly connected to the rear washing drum 22, so that the rear washing drum 22 can rotate along with the rotary shaft.

INDUSTRIAL APPLICABILITY

A drum washing machine in the present disclosure does not need to periodically clean the dirt on an outer wall or an inner wall of the washing drum, and so it is more water-saving.

What is claimed is:

1. A drum washing machine, comprising:

a washing machine housing, wherein a washing drum is disposed in the washing machine housing and comprises a front washing drum and a rear washing drum, wherein the front washing drum is sealedly connected to the rear washing drum, the rear washing drum is operative to rotate relative to the front washing drum, and the rear washing drum is operative to rotate along with a motor, wherein the front washing drum is stationary when the rear washing drum rotates along with the motor; and a sealing window pad, wherein a loading port is provided at a side of the washing machine housing, a door and window is arranged at the loading port, and the sealing window pad is disposed between the door and window and the front washing drum;

wherein the front washing drum is connected to the rear washing drum via a rotary bearing, the rear washing drum is sleeved on an inner ring of the rotary bearing, the front washing drum is engaged with an outer ring of the rotary bearing, and a second sealing ring is arranged between the front washing drum and the rear washing drum;

wherein a limiting ring having an F-shaped cross-section is disposed at a joint of the front washing drum and the rear washing drum;

wherein the limiting ring comprises a first vertical limiting ring body, a first transverse limiting ring body disposed on top of the first vertical limiting ring body, and a second transverse limiting ring body parallel to the first transverse limiting ring body; and wherein the second sealing ring is disposed between the first transverse limiting ring body and the second transverse limiting ring body, the rotary bearing is disposed in a space formed by the first vertical limiting ring body, the second transverse limiting ring body, and an outer wall of the rear washing drum.

2. The drum washing machine of claim 1, wherein the front washing drum has a smaller length than the rear washing drum.

3. The drum washing machine of claim 1, wherein the sealing window pad comprises an inner lip, an outer lip, and a folding member connecting the inner lip to the outer lip, wherein the inner lip is engaged with the front washing drum via a second clamp, and the outer lip is engaged with a front panel of the washing machine housing via a first clamp.

4. The drum washing machine of claim 1, wherein a central axis of the washing drum is inclined relative to a horizontal plane, the central axis forming an angle of $\alpha$ with the horizontal plane, wherein $0 \leq \alpha < 90°$.

5. The drum washing machine of claim 1, wherein at least one lifting rib is arranged on an inner side wall of the rear washing drum.

6. The drum washing machine of claim 1, wherein the second sealing ring is a lip-shaped sealing ring.

7. The drum washing machine of claim 1, wherein the front washing drum is provided with a water inlet hole, a water inlet valve is disposed on the housing of the washing machine and is communicated with a detergent box via a water inlet pipeline, and the detergent box is communicated with the water inlet hole via a water injection pipe.

* * * * *